US010844825B2

(12) United States Patent
Lorenz et al.

(10) Patent No.: US 10,844,825 B2
(45) Date of Patent: Nov. 24, 2020

(54) METHOD AND APPARATUS TO CONTROL AN IGNITION SYSTEM

(71) Applicant: DELPHI AUTOMOTIVE SYSTEMS LUXEMBOURG SA, Bascharage (LU)

(72) Inventors: Frank Lorenz, Trier (DE); Marco Loenarz, Esch/Aizette (LU)

(73) Assignee: DELPHI AUTOMOTIVE SYSTEMS LUXEMBOURG SA (LU)

( * ) Notice: Subject to any disclaimer, the term of this patent is extended or adjusted under 35 U.S.C. 154(b) by 5 days.

(21) Appl. No.: 16/092,969

(22) PCT Filed: Apr. 10, 2017

(86) PCT No.: PCT/EP2017/058568

§ 371 (c)(1),
(2) Date: Oct. 11, 2018

(87) PCT Pub. No.: WO2017/178436

PCT Pub. Date: Oct. 19, 2017

(65) Prior Publication Data

US 2019/0162155 A1 May 30, 2019

(30) Foreign Application Priority Data

Apr. 13, 2016 (GB) ..... 1603443.1

(51) Int. Cl.
*F02P 3/05* (2006.01)
*F02P 15/10* (2006.01)
(Continued)

(52) U.S. Cl.
CPC ..... *F02P 3/053* (2013.01); *F02P 3/0442* (2013.01); *F02P 3/0456* (2013.01);
(Continued)

(58) Field of Classification Search
CPC ..... F02P 3/053; F02P 3/0442; F02P 3/0456; F02P 3/0554; F02P 15/08; F02P 15/10; F02P 15/12
(Continued)

(56) References Cited

U.S. PATENT DOCUMENTS 3,919,993 A * 11/1975 Neuman ..... F02P 9/007 123/620
5,140,970 A 8/1992 Akaki et al.
(Continued)

FOREIGN PATENT DOCUMENTS

DE 10231511 A1 * 1/2004 ..... F02P 3/0435
DE 10231511 A1 1/2004
(Continued)

*Primary Examiner* — Mahmoud Gimie
*Assistant Examiner* — Joshua Campbell
(74) *Attorney, Agent, or Firm* — Joshua M. Haines

(57) ABSTRACT

An ignition system includes a controller which controls two stages—to provide current to a spark plug. The stages include a first transformer including a first primary winding and a first secondary winding and a second transformer including a second primary winding and a second secondary winding. A switch is electrically connected between a supply high side and the high side of the first primary winding. A second switch is electrically connected between the first primary winding and the power supply low side supply. A third switch is connected between the junction of the switch and high side end of the first inductor and a point between the low side of the second primary winding and low side supply. A fourth switch is located between the low side of the second primary winding and the point. A fifth switch is located between the point and low side supply.

10 Claims, 12 Drawing Sheets

(51) Int. Cl.

| | |
|---|---|
| ***F02P 3/055*** | (2006.01) |
| ***F02P 3/04*** | (2006.01) |
| ***F02P 3/045*** | (2006.01) |
| ***F02P 15/08*** | (2006.01) |
| ***F02P 15/12*** | (2006.01) |

(52) U.S. Cl.
CPC ..... *F02P 3/0554* (2013.01); *F02P 15/08* (2013.01); *F02P 15/10* (2013.01); *F02P 15/12* (2013.01)

(58) Field of Classification Search
USPC ..... 123/644
See application file for complete search history.

(56) References Cited

U.S. PATENT DOCUMENTS

| | | | | |
|---|---|---|---|---|
| 5,193,515 | A | 3/1993 | Oota et al. | |
| 6,283,104 | B1 * | 9/2001 | Ito | F02P 3/051 123/637 |
| 7,121,270 | B1 | 10/2006 | Plotnikov | |
| 7,353,813 | B2 * | 4/2008 | Shiraishi | F02D 41/3023 123/634 |

FOREIGN PATENT DOCUMENTS

| | | | | |
|---|---|---|---|---|
| EP | 2325476 | A1 * | 5/2011 | F02P 15/10 |
| EP | 2876298 | A1 | 5/2015 | |
| EP | 2325476 | B1 | 4/2016 | |
| JP | 2002004994 | A | 1/2002 | |

* cited by examiner

| CONTROL CHART | SWITCH | | | | | | FOLLOWING STATE(S) POSSIBLE |
|---|---|---|---|---|---|---|---|
| STATE | Q1 | Q2 | M1 | M2 | M3 | | |
| MAIN | 0 | 0 | 0 | 0 | 0 | | INITIAL CHARGE |
| INITIAL CHARGE | 1 | 1 | 0 | 0 | 1 | | INITIAL CHARGE/HV BREAKDOWN |
| INITIAL CHARGE / HV-HV BREAKDOWN | 0 | 0 | 0 | 0 | 0 | | MultigbtNxt-Q1 ON |
| MultiigbtNxt -Q1 ON | 1 | 0 | 1 | 0 | 0 | | MultigbtXLoop (NOT SHOWN HERE => CONTROL LOOP) |
| MultiigbtNxt -Q2 ON | 0 | 1 | 0 | 1 | 0 | | MultigbtXLoop (NOT SHOWN HERE => CONTROL LOOP) |
| IpmaxStepDown - Q1 ON | 1 | 0 | T | 1 | T | DETAILS SEE BELOW | SUBPROGRAM OF MultigbtXLoop |
| IpmaxStepDown - Q2 ON | 0 | 1 | 1 | T | T | | SUBPROGRAM OF MultigbtXLoop |
| | | | | | | | |
| | | | | | | | |
| | | | | | | | |
| IpmaxStepDown - Q1 ON | Q1 | Q1 | Q1 | Q1 | Q1 | TIME (US) E.G. | |
| | 1 | 0 | 0 | 1 | 1 | 0 | |
| | 1 | 0 | 1 | 1 | 0 | 16 | |
| | 1 | 0 | 0 | 1 | 1 | 32 | |
| | ••• | ••• | ••• | ••• | ••• | | |

FIG. 5

METHOD AND APPARATUS TO CONTROL AN IGNITION SYSTEM

CROSS REFERENCE TO RELATED APPLICATIONS

This application is a national stage application under 35 USC 371 of PCT Application No. PCT/EP2017/058568 having an international filing date of Apr. 10, 2017, which is designated in the United States and which claimed the benefit of GB Patent Application No. 1603443.1 filed on Apr. 13, 2016, the entire disclosures of each are hereby incorporated by reference in their entirety.

TECHNICAL FIELD

The present invention relates to an ignition system and method of controlling spark plugs. It has particular but not exclusive application to systems which are adapted to provide a continuous spark, such as a multi-spark plug ignition system.

BACKGROUND OF THE INVENTION

Ignition engines that use very lean air-fuel mixtures have been developed, that is, having a higher air composition to reduce fuel consumption and emissions. In order to provide a safe ignition it is necessary to have a high energy ignition source. Prior art systems generally use large, high energy, single spark ignition coils, which have a limited spark duration and energy output. To overcome this limitation and also to reduce the size of the ignition system multi-charge ignition systems have been developed. Multi-charge systems produce a fast sequence of individual sparks, so that the output is a long quasi-continuous spark. Multi-charge ignition methods have the disadvantage that the spark is interrupted during the recharge periods, which has negative effects, particularly noticeable when high turbulences are present in the combustion chamber. For example this can lead to misfire, resulting in higher fuel consumption and higher emissions.

An improved multi-charge system is described in European Patent EP2325476 which discloses a multi-charge ignition system without these negative effects and, at least partly, producing a continuous ignition spark over a wide area of burn voltage, delivering an adjustable energy to the spark plug and providing with a burning time of the ignition fire that can be chosen freely.

One drawback of current systems is the high primary current peak at the initial charge. That current peak is unwanted, it generates higher copper-losses, higher EMC-Emissions and acts as a higher load for the onboard power generation (generator/battery) of the vehicle. One option to minimize the high primary current peak is a DC/DC converter in front of the ignition coil (e.g. 48 V). However this introduces extra cost.

It is an object of the invention to minimize the high primary current peak without the use of a DC/DC converter.

STATEMENT OF THE INVENTION

In one aspect is provided a multi-charge ignition system including a spark plug control unit adapted to control at least two coil stages so as to successively energise and de-energise said coil stage(s) to provide a current to a spark plug, said two stages comprising a first transformer (T1) including a first primary winding (L1) inductively coupled to a first secondary winding (L2); a second transformer (T2) including a second primary winding (L3) inductively coupled to a second secondary winding (L4); characterised in including first switch means M1 electrically connected between a voltage supply high side and the high side of the first primary winding, a second switch Q1 electrically connected between the first primary winding and the power supply low side supply/earth, a third switch connected between the junction of the first switch and high side end of the first inductor and a point between the low side of the second primary winding and low side supply/earth, and further including a fourth switch located between the low side of the second primary winding and said point, and a fifth switch located between said point and low side supply/earth.

In a further aspect is provided a method of operating a system as above including in a non-operational state, setting all switches M1 M2 M3 Q1 Q2 to off.

In a further aspect is provided a method of operating a system as above including, during an initial ramp-up phase, switching switches Q1, Q2, M3 to on, and M1,M2 to off.

In a further aspect is provided a method of operating a system as above including, after said initial ramp up stage, switching Q1 and Q2 to off.

In a further aspect is provided a method of operating a system as above including during a coupled multi-charge phase, setting the switches alternately to/from the following settings a) Q1/M1 on, Q2/M2/M3 off and b) Q1/M1/M3 off, Q2/M2 on.

In a further aspect is provided a method of operating a system as above including, in a step-down phase, setting the switches a) Q2/M1/M3 on, Q1/M2 off and toggling M2/M3.

In a further aspect is provided a method of operating a system as above including, in a step-down phase Q1/M2/M3 on, Q2/M1 on and toggling M1/M3.

BRIEF DESCRIPTION OF DRAWINGS

The invention will now be described by way of example and with reference of the following drawings of which:

FIG. 5 shows an operational table.

PRIOR ART

Figure 1:
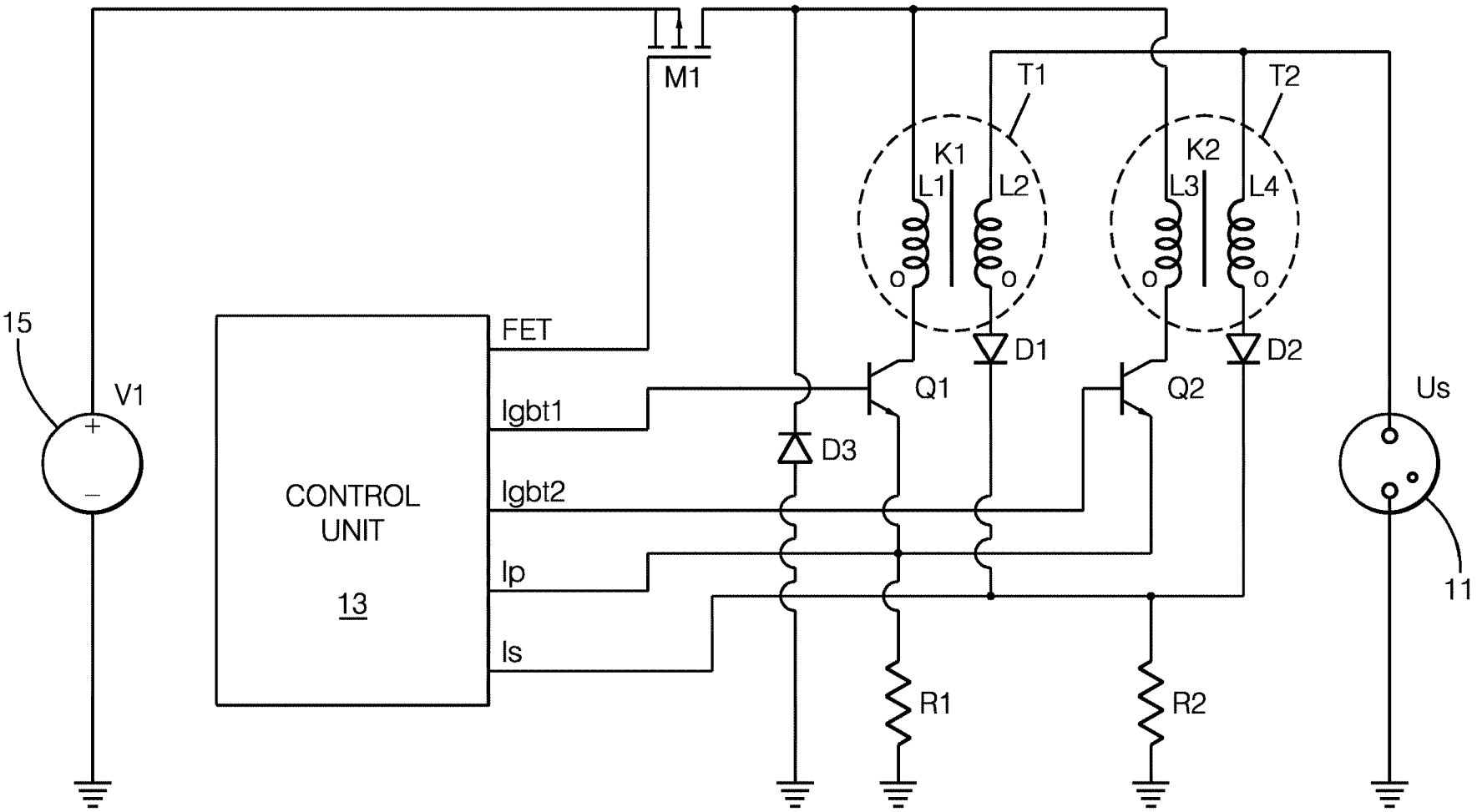
FIG. 1 shows the circuitry of a prior art coupled-multi-charge ignition system.

FIG. 1 shows the circuitry of a prior art coupled-multi-charge ignition system for producing a continuous ignition spark over a wide area of burn voltage servicing a single set of gapped electrodes in a spark plug 11 such as might be associated with a single combustion cylinder of an internal combustion engine (not shown). The CMC system uses fast charging ignition coils (L1-L4), including primary windings, L1, L2 to generate the required high DC-voltage. L1 and L2 are wound on a common core K1 forming a first transformer (coil stage) and secondary windings L3, L4 wound on another common core K2 are forming a second transformer (coil stage). The two coil ends of the first and second primary 20 windings L1, L3 may be alternately switched to a common ground such as a chassis ground of an automobile by electrical switches Q1, Q2. These switches Q1, Q2 are preferably Insulated Gate Bipolar Transistors. Resistor R1 may be optionally present for measuring the primary current Ip that flows from the primary side and is connected between the switches Q1, Q2 and ground, while optional resistor R2 for measuring the secondary current Is that flows from the secondary side is connected between the diodes D1, D2 and ground.

The low-voltage ends of the secondary windings L2, L4 may be coupled to a common ground or chassis ground of an automobile through high-voltages diodes D1, D2. The high-voltage ends of the secondary ignition windings L2, L4 are coupled to one electrode of a gapped pair of electrodes in a spark plug 11 through conventional means. The other electrode of the spark plug 11 is also coupled to a common ground, conventionally by way of threaded engagement of the spark plug to the engine block. The primary windings L1, L3 are connected to a common energizing potential which may correspond to conventional automotive system voltage in a nominal 12V automotive electrical system and is in the figure the positive voltage of battery. The charge current can be supervised by an electronic control circuit 13 that controls the state of the switches Q1, Q2. The control circuit 13 is for example responsive to engine spark timing (EST) signals, supplied by the ECU, to selectively couple the primary windings L1 and L2 to system ground through switches Q1 and Q2 respectively controlled by signals Igbt1 and Igbt2, respectively. Measured primary current Ip and secondary current Is may be sent to control unit 13. Advantageously, the common energizing potential of the battery 15 is coupled by way of an ignition switch M1 to the primary windings L1, L3 at the opposite end that the grounded one. Switch M1 is preferably a MOSFET transistor. A diode D3 or any other semiconductor switch (e.g. MOSFET) is coupled to transistor M1 so as to form a step-down converter. Control unit 13 is enabled to switch off switch M1 by means of a signal FET. The diode D3 or any other semiconductor switch will be switched on when M1 is off and vice versa.

In prior art operation, the control circuit 13 is operative to provide an extended continuous high-energy arc across the gapped electrodes. During a first step, switches M1, Q1 and Q2 are all switched on, so that the delivered energy of the power supply 15 is stored in the magnetic circuit of both transformers (T1, T2). During a second step, both primary windings are switched off at the same time by means of switches Q1 and Q2. On the secondary side of the transformers a high voltage is induced and an ignition spark is created through the gapped electrodes of the spark plug 11. During a third step, after a minimum burn time wherein both transformers (T1, T2) are delivering energy, switch Q1 is switched on and switch Q2 is switched off (or vice versa). That means that the first transformer (L1, L2) stores energy into its magnetic circuit while the second transformer (L3, L4) delivers energy to spark plug (or vice versa). During a fourth step, when the primary current Ip increases over a limit (Ipmax), the control unit detects it and switches transistor M1 off. The stored energy in the transformer (L1, L2 or L3, L4) that is switched on (Q1, or Q2) impels a current over diode D3 (step-down topology), so that the transformer cannot go into the magnetic saturation, its energy being limited. Preferably, transistor M1 will be permanently switched on and off to hold the energy in the transformer on a constant level. During a fifth step, just after the secondary current Is falls short of a secondary current threshold level (Ismin) the switch Q1 is switched off and the switch Q2 is switched on (or vice versa). Then steps 3 to 5 will be iterated by sequentially switching on and off switches Q1 and Q2 as long as the control unit switches both switches Q1 and Q2 off.

Figure 2:
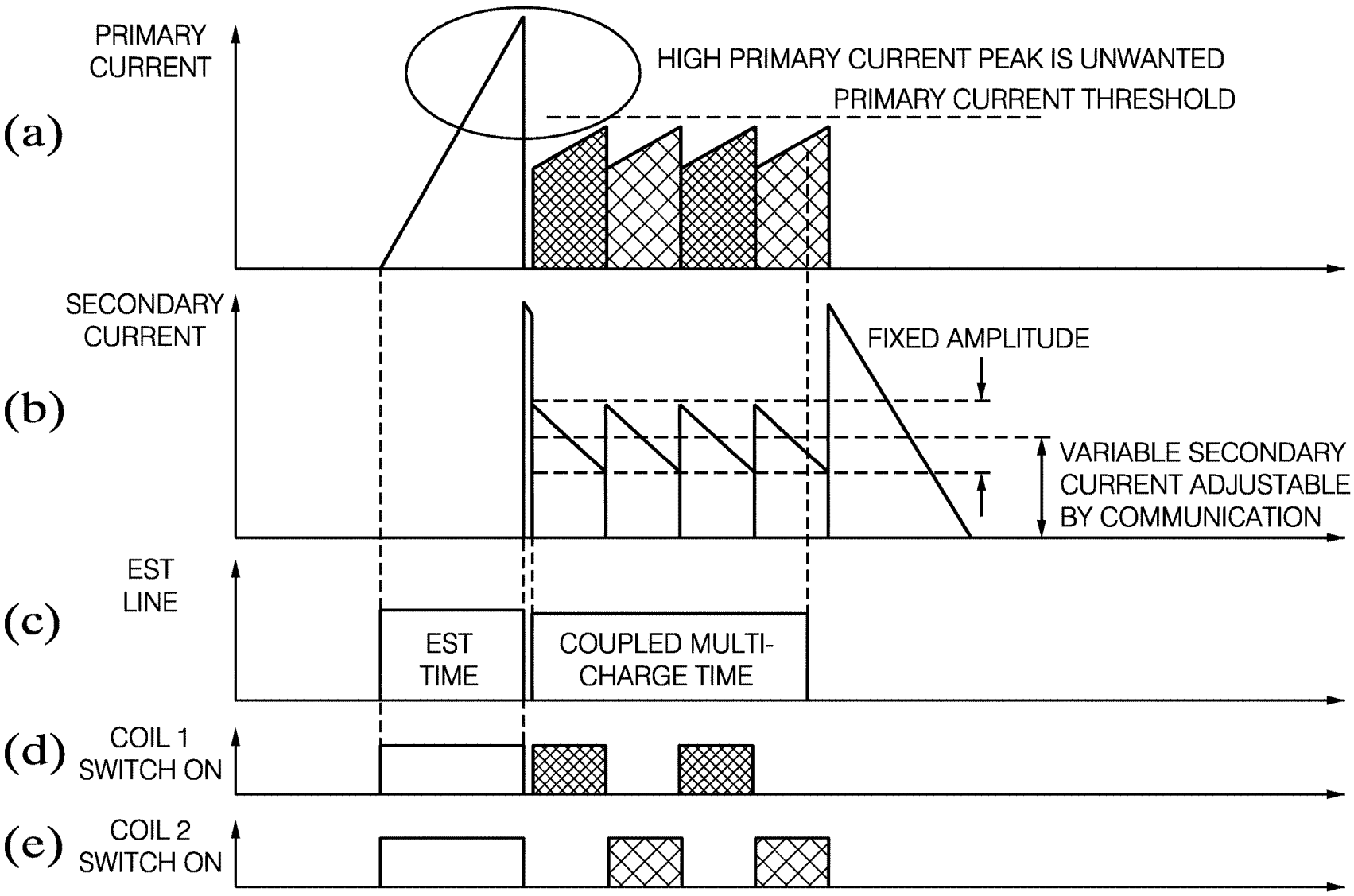
FIG. 2 shows timeline of the FIG. 1 systems for primary and secondary current, EST signal and coil 1 switch and coil 2 switch "on" times.

FIG. 2 shows timeline of ignition system current; FIG. 2*a* shows a trace representing primary current Ip along time. FIG. 2*b* shows the secondary current Is. FIG. 2*c* shows the signal on the EST line which is sent from the ECU to the ignition system control unit and which indicates ignition time. During step 1, i.e. M1, Q1 and Q2 switched on, the primary current Ip is increasing rapidly with the energy storage in the transformers. During step 2, i.e. Q1 and Q2 switched off, the secondary current Is is increasing and a high voltage is induced so as to create an ignition spark through the gapped electrodes of the spark plug. During step 3, i.e. Q1 and Q2 are switched on and off sequentially, so as to maintain the spark as well as the energy stored in the transformers. During step 4, comparison is made between primary current Ip and a limit Ipth. When Ip exceeds Ipth M1 is switched off, so that the "switched on" transformer cannot go into the magnetic saturation, by limiting its stored energy. The switch M1 is switched on and off in this way, that the primary current Ip is stable in a controlled range. During step 5, comparison is made between the secondary current Is and a secondary current threshold level Isth. If Is<Isth, Q1 is switched off and Q2 switched on (or vice versa). Then steps 3 to 5 will be iterated by sequentially switching on and off Q1 and Q2 as long as the control unit switches both Q1 and Q2 off. Because of the alternating charging and discharging of the two transformers the ignition system delivers a continuous ignition fire. The above describes the circuitry and operation of a prior art ignition system to provide a background to the current invention. In some aspects of the invention the above circuitry can be used. The invention provides various solutions to enhance performance and reduce spark-plug wear. FIGS. 2*d* and *e* show the operating states of the respective coils by virtue of the switch on and off times.

DETAILED DESCRIPTION OF THE INVENTION

Example 1

Figure 3A:
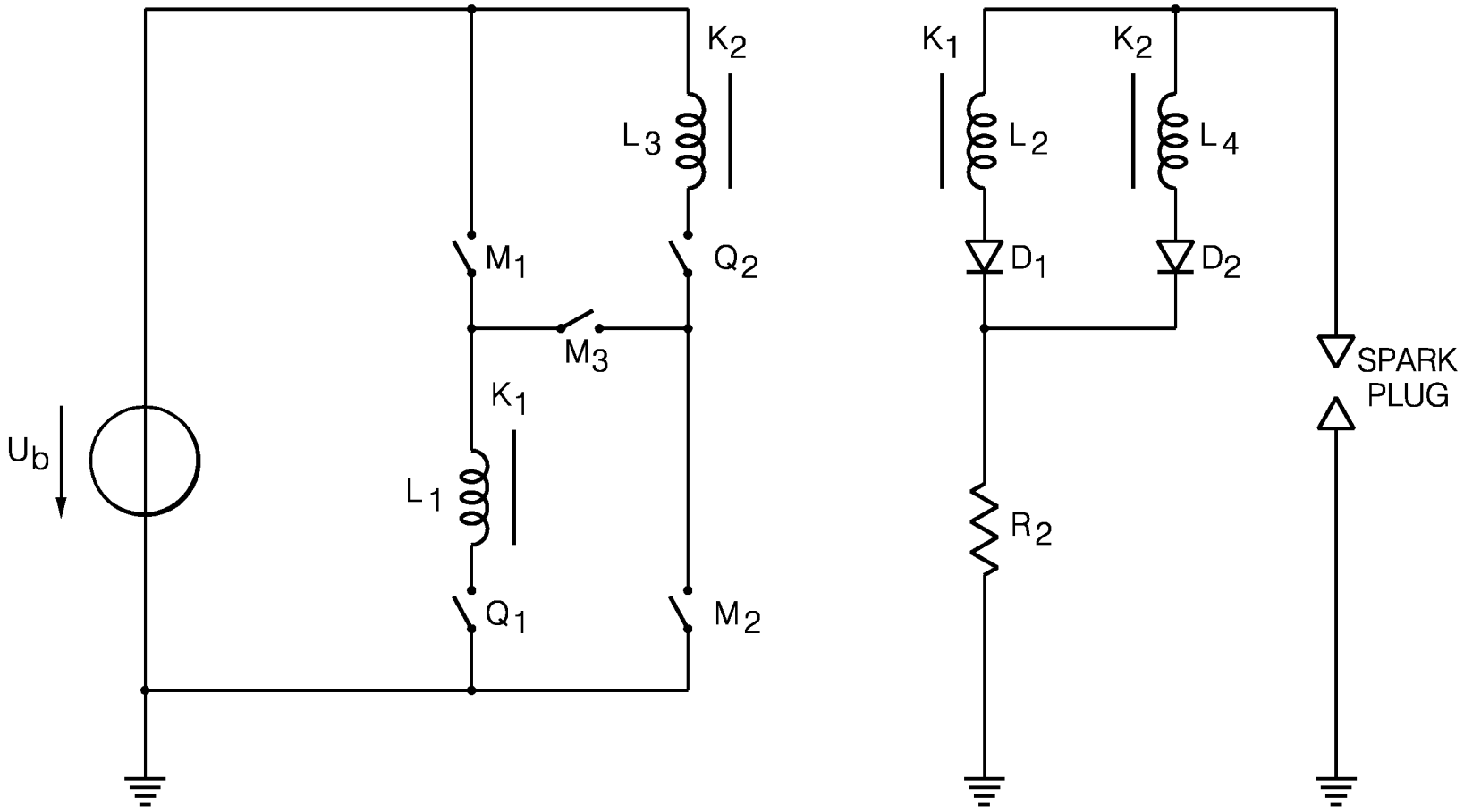
FIG. 3*a* shows a circuit of a coupled multi-charge system according to one example.

FIG. 3*a* shows a schematic circuit according to one example—it is similar to that of FIG. 1. In order for enhanced clarity the primary side of the circuit is shown separately to the secondary side of the circuit. e.g. the primary coils are shown separate from the secondary coils. It is to be understood however that the two cores shown in the figure K1 and K2 are each represented twice but in reality there is only one of each; inductor coils L1 and L2 share the same common core K1 and L3 and L4 share the same common core K2.

In the example a power switch M1 is located similarly arranged to M1 in the FIG. 1. This switch is located between the power e.g. battery high side and the high side of the coil L1. Low sides of the inductor coils L1 and L3 are connected through ground via switches Q1 and Q2. A further power switch is connected between the high side of inductor L1 and the low side of inductor L3. A further power switch M2 connects the switch Q2 to earth.

On the secondary side the two secondary coil which are arranged in parallel each have a diode in series connecting the low sides of the coils to earth via the shunt resistor R2, R2 is used to measure the secondary current.

Any of the switches M1, M2, M3, Q1 or Q2 may be controlled by the ECU and/or spark control unit (not shown).

The circuit needs only one additional power switch instead of having two as described in DP-322180. The two transformers are connected symmetrically to the battery.

Figure 3B:
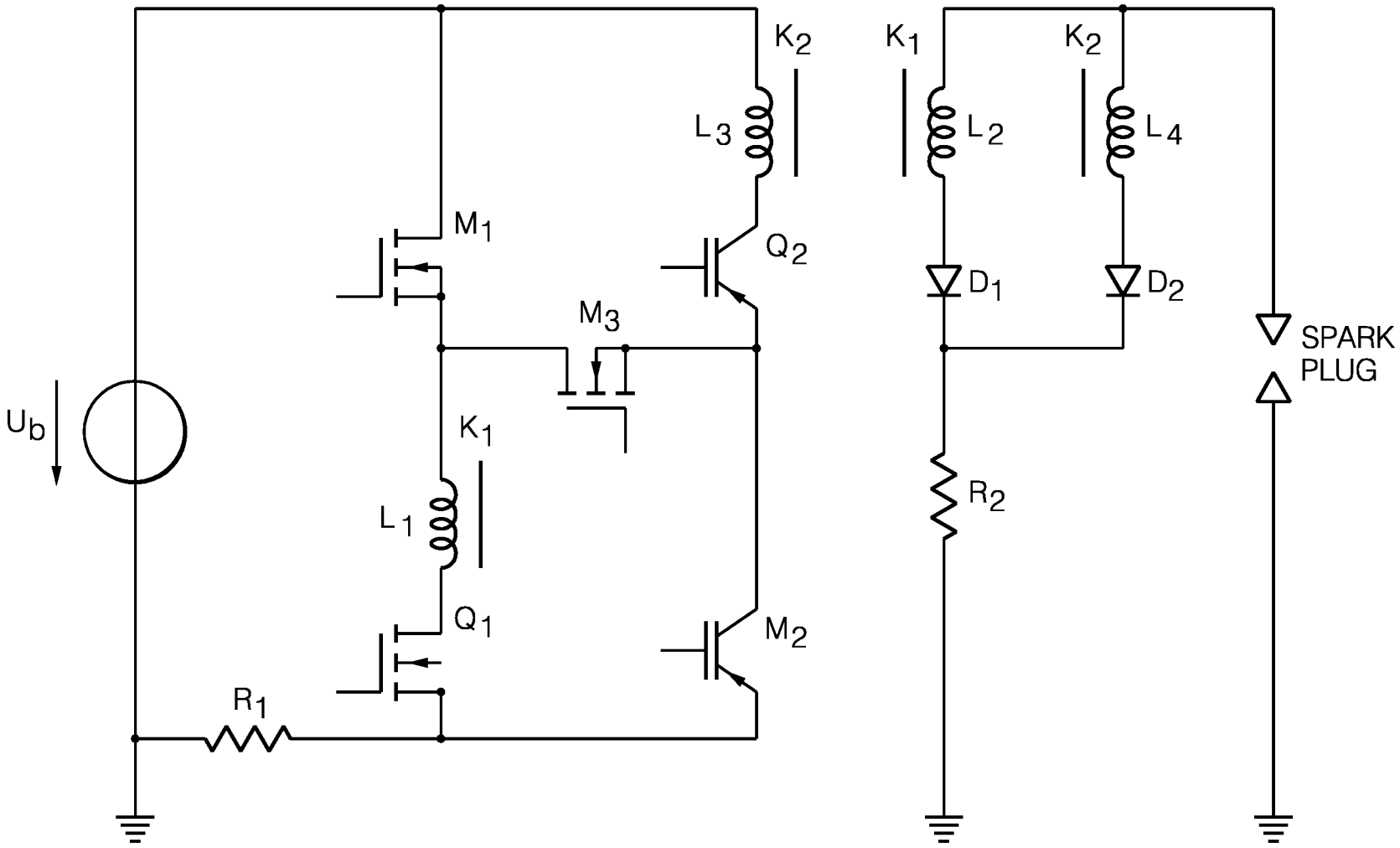
FIG. 3*b* shows an alternative example with preferred switches.

FIG. 3*b* shows an alternative example with preferred switches.

The circuits may include means to measure the voltage at the high voltage HV-diodes (D1 and D2), though this is optional, the supply voltage (Ubat) can additionally and optionally be measured.

The operation of the circuit according to the examples such as FIGS. 3*a* and 3 *b* may be implemented as follows with reference to the flow charts of the drawings. Also at the end of the description is a list of the abbreviations/definitions.

A) Main Loop

Figure 4A:
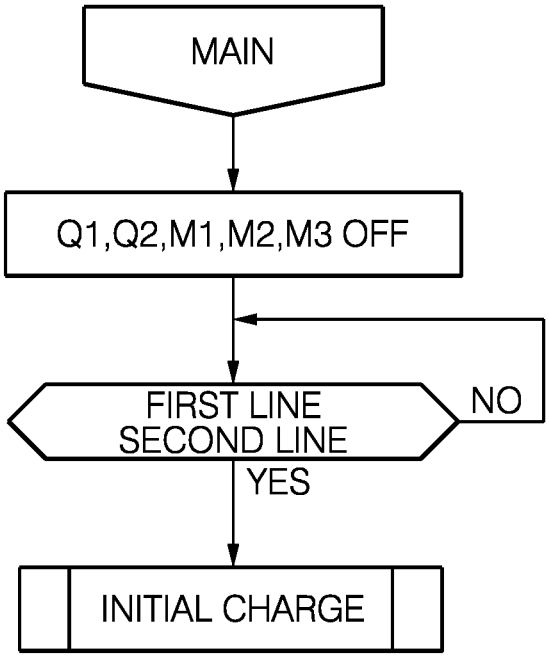
FIGS. 4*a* to 4*g* show flow charts of the methodology of operating examples in preferred embodiments.

FIG. 4*a* shows a flow chart of the main loop

At the beginning all power switches are off. The coil is waiting in a loop for the control signal (EST signal) from the ECU. When EST is high "Initial Charge" is starting. The process then proceeds to the Initial Charge process.

B) Initial Charge

Figure 4B:
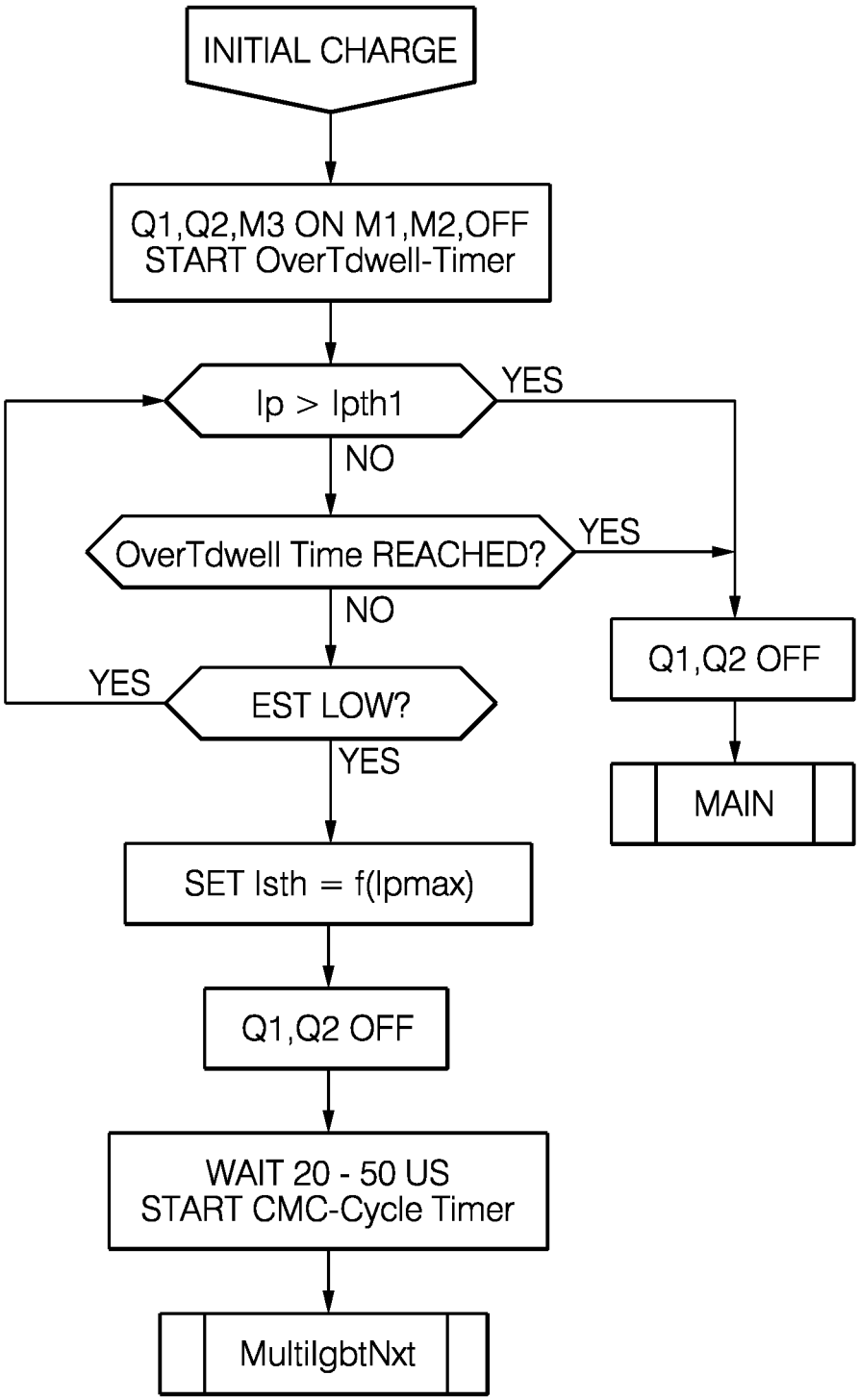

FIG. 4*b* shows a flow chart for this phase. For the initial charge both coil stages are connected in series: Q1, Q2, M3 are on: The current flows through L3, L1 and R1. With this energy is stored in both transformers. The primary current is measured via R1, if the current is too high both IGBTs are switched off as a safety feature. The Tdwell-time is detected, if the time is too high both IGBTs are switched off; this is a safety feature. Typical Tdwell time for a CMC-coil is between 600 us and 1400 us. Both transformers are charged as long as the EST-signal of the ECU is high. At the falling edge:

i) First the maximum primary current (Ipmax) is sampled and the secondary current threshold is set as a function of Ipmax. Isth=Ipmax/2/ue−dIs, whereas dIs is a value between ~30 mA to 80 mA ii) Both IGBTs Q1 and Q2 are switched off. At this time the high voltage on the secondary side is induced. The ignition spark is generated.

iii) A small delay time is needed to generate a robust spark, (20-50 us) The CMC-cycle timer is started. Typical value for the CMC-Timer is between 500 us (at high RPMs) and 15 ms (at low RPMs, e.g. cold start)

iv) Go to the next step which is "MultiIgbtNxt"

C) MultiIgbtNxt

Figure 4C:
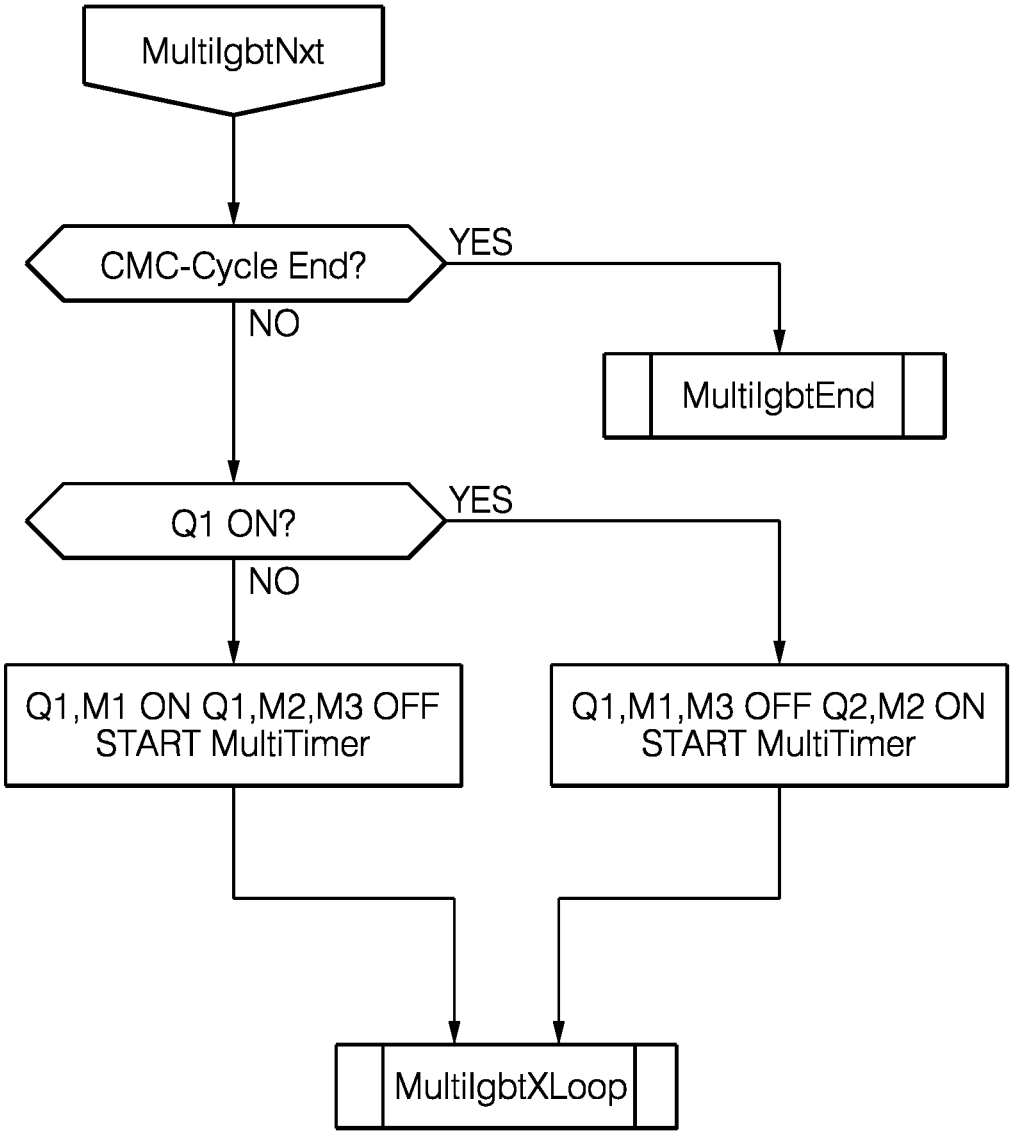

FIG. 4*c* shows a flow chart for this phase. This program section is used between each toggle cycle. The main goal of this system is to maintain a continuous secondary current and with this to toggle between two characteristic stated:

Coil 1 is charging and Coil 2 firing: Q1, M1 are on and Q2, M2, M3 are off Coil 1 is firing and Coil 2 is charging: Q1, M1, M3 are off and Q2, M2 are on The following steps are taken:

i) Checking if the CMC-cycle is finished. The CMC-cycle can be finished via the ECU interface or the CU of the coil via a timer (CMC-Timer). If finished go on with "MultiIgbtEnd"

ii) Needed to identify the toggling operation. Igbt Q1 is switched on? This means the first CMC-cycle starts always with the coil stage 1 iii) Two possibilities:

If Q1 was off, charge coil 1 and fire coil 2: Q1, M1 are on and Q2, M2, M3 are off. The MultiTimer is started, which is needed to limit the CMC-toggling frequency.

If Q1 was on, fire coil 1 and charge coil 2: Q1, M1, M3 are off and Q2, M2 are on. The MultiTimer is started, which is needed to limit the CMC-toggling frequency.

iv) Proceed to MultiIgbtXLoop phase

D) MultiIgbtXLoop

Figure 4D:
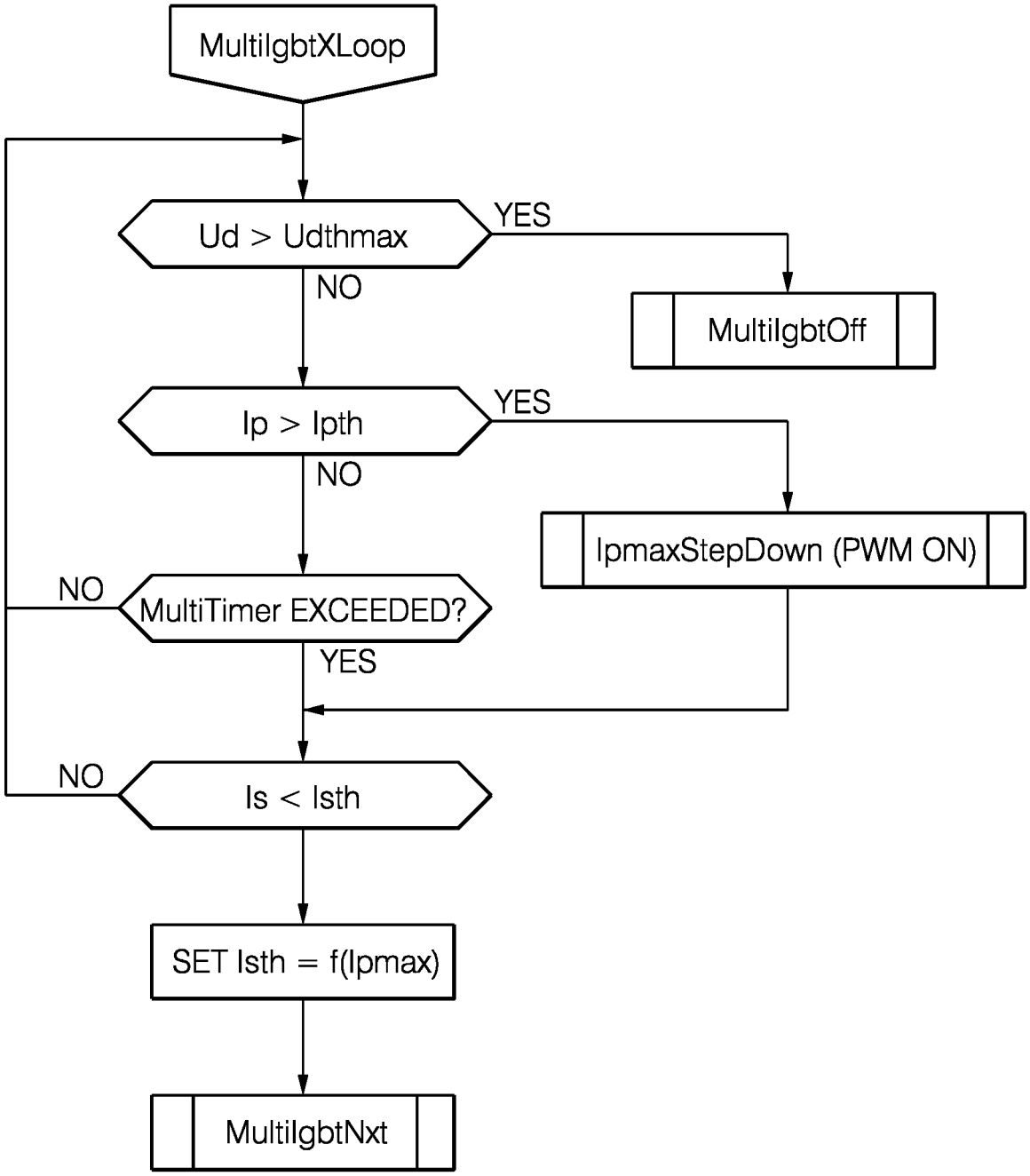

FIG. 4*d* shows a flow chart of this phase. The main goal of this phase on is to measure different current and voltages and to react on it, if the corresponding value is out of range.

i) The voltage at the diode is monitored. If the voltage is too high go on with MultiIgbtOff (recharge both coils to protect the HV-diodes)

ii) Detect the primary current Ip:

a. Ip higher than IpthCMC too high proceed to "Ipmax-StepDown" phase which limits the primary current, then go to step iii). The value of IpthCMC is typically in a range between 15 A and 35 A.

b. Go to step iii)

iii) Check the MultiTimer, if the timer has reached an adaptable time, then go on with step i, otherwise go on with step iv). A typical time for the MultiTimer is in the range between 80 us and 500 us.

iv) Check if the secondary current Is is below the threshold value Isth:

a. If no, go to step i)

b. If yes, go to step v) with MultiIgbtNxt (toggle coil stages)

v) The secondary current threshold Isth is set as a function of the measured maximum current Ipmax. Then go to the MultiIgbtNxt phase (toggle coil stages).

E) MultiIgbtOff

Figure 4E:
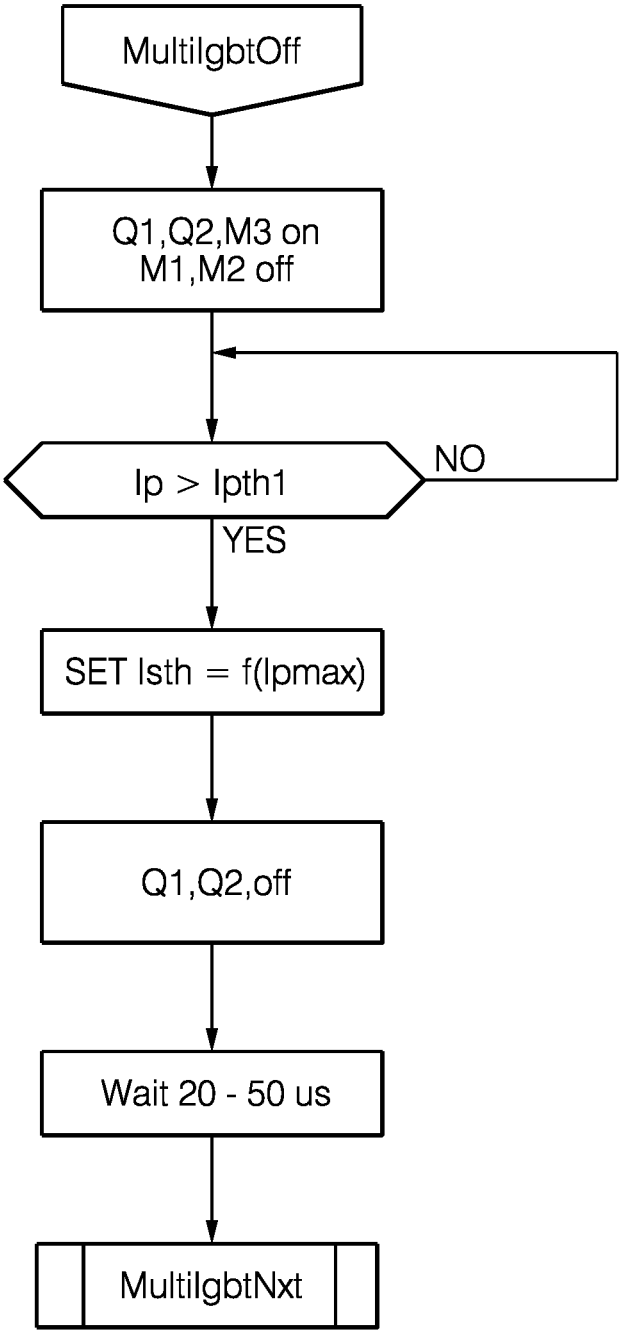

FIG. 4*e* shows the flow chart of this phase. This phase is initiated when the voltage at the HV-diodes is too high and is needed to protect the HV-diodes of too high voltages by switching on both transformers. This is similar to the initial charge phase.

i) Both coil stages are connected in series: Q1, Q2, M3 are on and M1, M2 are off: The current flows through L3, L1 and R1. With this energy is stored in both transformers. The primary current is measured via R1.

ii) Detect primary current Ip:

a. Ip higher than Ipth1 than go to step iii). Ipth1 is in the range between 15 and 35 A.

b. Recharge both coils as long the primary current reaches the limit iii) The maximum primary current (Ipmax) is sampled and the secondary current threshold is set as a function of Ipmax. Isth=Ipmax/2/ue−dIs, whereas dIs is a value between ~30 mA to 80 mA iv) Both IGBTs Q1 and Q2 are switched off. At this time the high voltage on the secondary side is induced. The ignition spark is generated.

v) A small delay time is needed to generate a robust spark, (20-50 us)

vi) Go to the MultiIgbtNxt phase (toggle coil stages).

F) MultiIgbtEnd

Figure 4F:
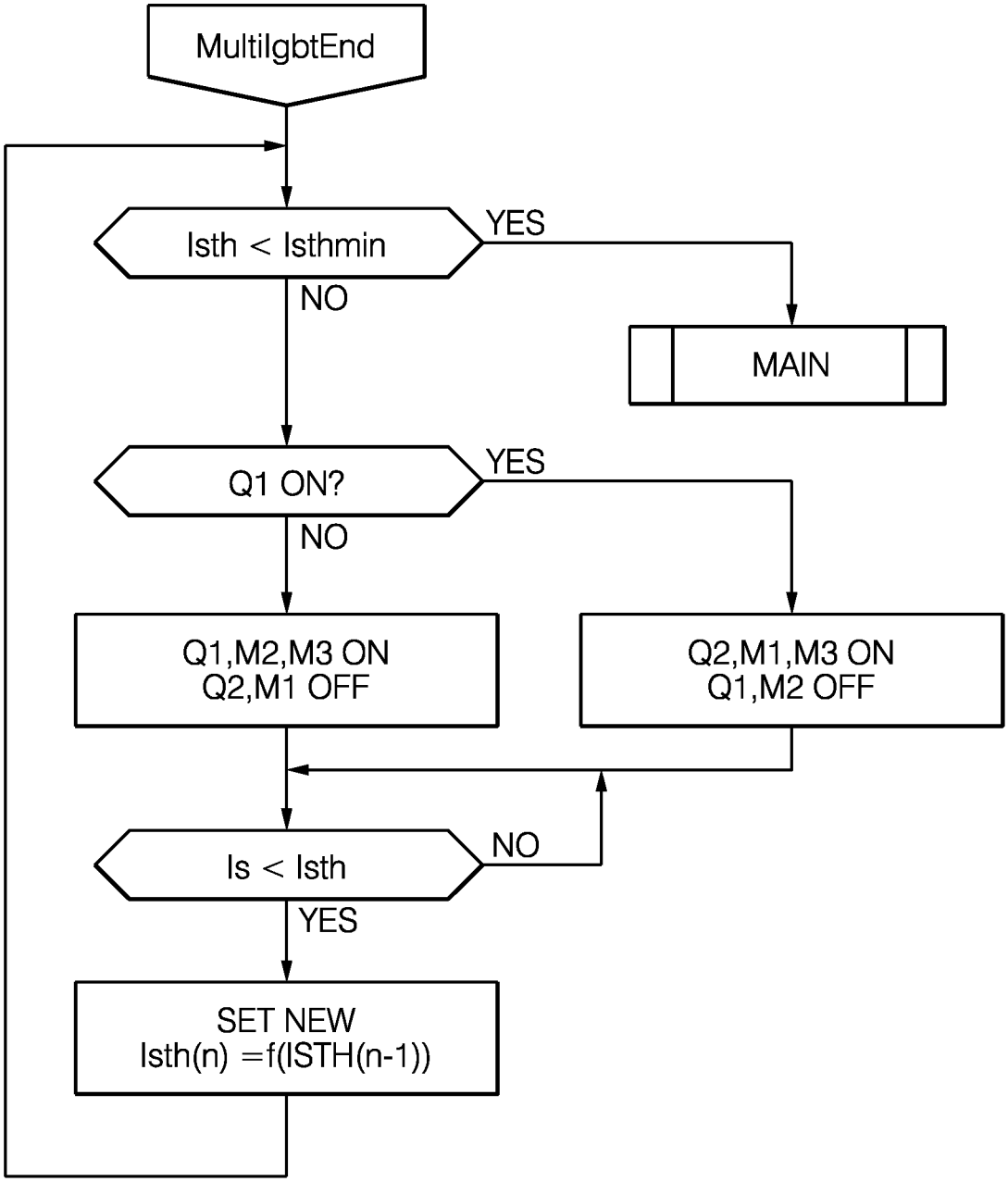

FIG. 4*f* shows a flow chart of the "MultiIgbtEnd" phase. Here the secondary current is ramped down to zero, this is needed to minimize the spark plug wear. The following steps are taken:

i) If the secondary current threshold Isth, which is used for the ramp down, is below the minimum secondary current threshold, then go on with Main (FIG. 4*a*)

ii) Which Igbt is on?

a. Q1 is off: Switch Q1, M2, M3 on and Q2, M1 off. Herewith coil 1 is firing and coil 2 is in the free-wheeling mode and current flows through L3, Q2, M3, M1 b. Q1 is on: Switch Q2, M1, M3 on and Q1, M2 off. Herewith coil 2 is firing and coil 1 is in the free-wheeling mode then current flows through L1, Q1, M3, M2 iii) Wait until the secondary current Is falls short of Isth, then go to step iv)

iv) The new secondary current threshold Isth(n) is set dependent on the old Isth(n−1) value: Isth(n)=Isth(n−1)−dIs, whereas dIs is in the range of 20-50 mA.

G) IpmaxStepDown

Figure 4G:
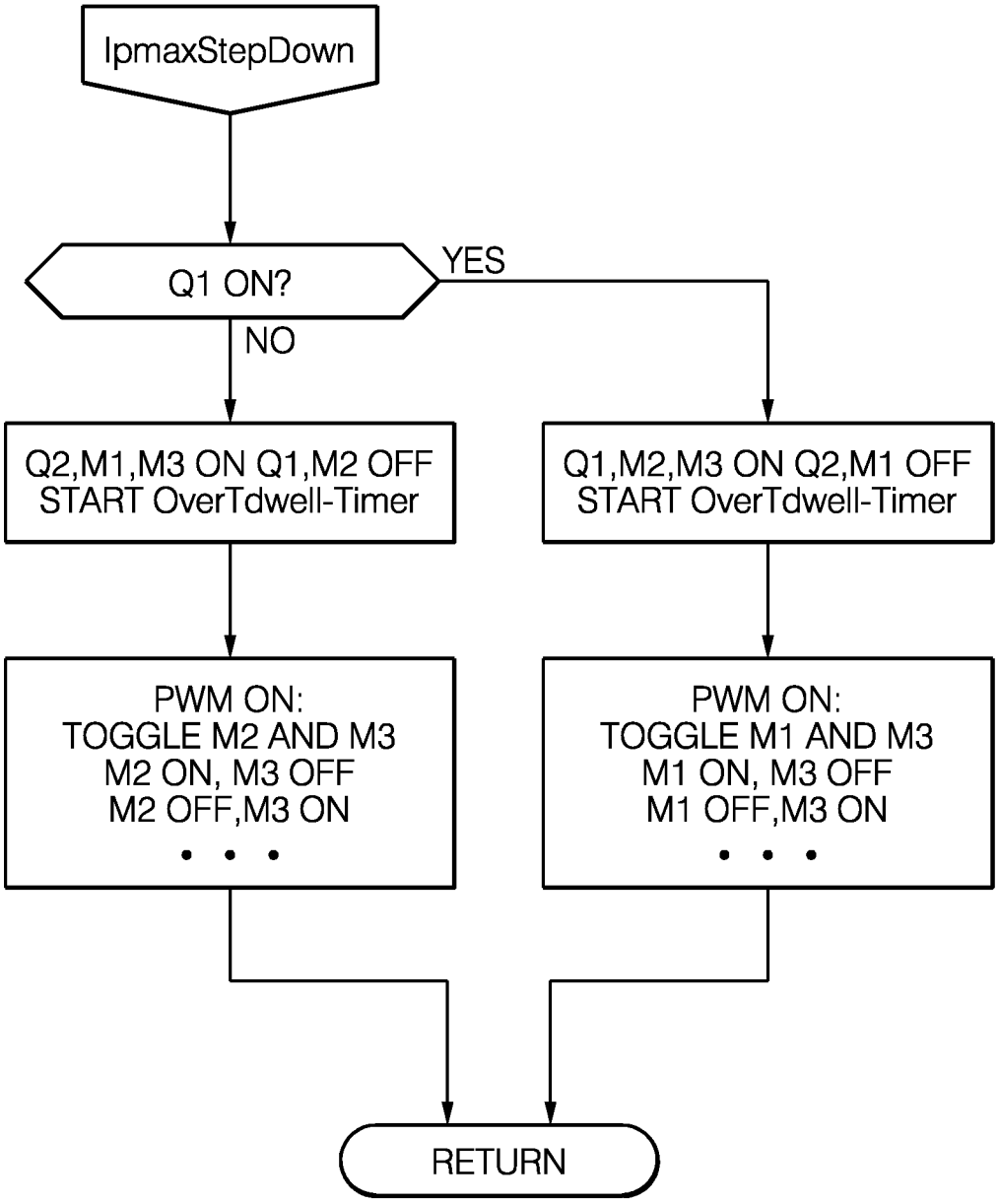

FIG. 4g shows the IpmaxStepDown phase. This function/phase is needed to limit the primary current to a maximum value. In this mode the current flows in a freewheeling path and with this feature the current is limited and with this the stored energy. This function is called during CMC-cycle, where one coil is charged and the other coil is discharged/firing.

1) Which Igbt is on?

a. Q1 is off:

i. Coil 2 is switched into the step-down-mode by switching Q2, M1 and M3 on.

ii. Toggle M2 and M3 via a PWM signal the PWM signal is switched on as long as the CMC-cycle is toggled to the next stage (MultiIgbtNxt)

b. Q1 is on:

i. Coil 1 is switched into the step-down-mode by switching Q1, M2 and M3 on.

ii. Toggle M1 and M3 via a PWM signal the PWM signal is switched on as long as the CMC-cycle is toggled to the next stage (MultiIgbtNxt)

The table of FIG. 5 below shows the timing: Inside the step-down-state M1 and M3 are toggled (T), when Q1 is switched on resp. M2 and M3 when Q2 is switched on. The "MultiIgbtNxt" refers to the CMC-Mode (MultiCharge Mode)

Summary of Control

Below shows a summary of the control of switches for the salient phases a) Initially all switches are off at the beginning, whereas it is only important here that no power current flows into the circuit (no closed circuit) Q1 Q2 M1 M2 M3—all off b) For the initial ramp up we are switching Q1/Q2/M3 on, M1/M2 off (start over Tdwell-Timer)

c) Then we are switching all switches off, whereas the most important one are Q1 and Q2, these must be off. The other ones must be switched in that way, that there is no short circuit.

d) For the CMC-Mode, the switches move from(between): Q1/M1 on, Q2/M2/M3 off and Q1/M1/M3 off, Q2, M2 on L1—Primary inductance coil 1
L2—Secondary inductance coil 1
L3—Primary inductance coil 2
L4—Secondary inductance coil 2
K1—Magnetic coupling factor coil 1
K2—Magnetic coupling factor coil 2
R1—Primary current shunt resistor
R2—Primary current shunt resistor
Q1—IGBT for coil stage 1
Q2—IGBT for coil stage 2
D1—High voltage diode coil 1
D2—High voltage diode coil 2
M1—Power switch (MOSFET), step down switch coil 2
M2—Power switch (MOSFET), step down switch coil 1
M3—Power switch (MOSFET), series connection and step down switch
ue—winding ratio, between secondary and primary winding
Ub—Battery voltage
Us—Secondary voltage, spark plug voltage
Ud—High voltage diode voltage
Udthmax—High voltage diode switching threshold voltage
ECU—Engine Control Unit
EST—Engine Spark Timing, common name for the control signal coming from the ECU
CU—Control Unit of the ignition coil
CMC—Coupled MultiCharge Ignition
Ipth—Primary current switching threshold in CMC
Ipth1—Primary current switching threshold during the initial charge
Isth—Secondary current switching threshold in CMC
Ipmax—Maximum primary current peak after initial charge
Ipthmax—Maximum primary current switching threshold in step-down-operation
PWM—Pulse Width Modulation

The invention claimed is:

1. A multi-charge ignition system controlled by a spark plug control unit to provide a current to a spark plug, the multi-charge ignition system comprising:

at least two coil stages controlled by the spark plug control unit to successively energise and de-energise the at least two coil stages to provide the current to the spark plug, the at least two coil stages comprising a first transformer including a first primary winding inductively coupled to a first secondary winding and a second transformer including a second primary winding inductively coupled to a second secondary winding;

a first switch electrically connected between a power supply high side and a high side of the first primary winding;

a second switch electrically connected between a low side of the first primary winding and a power supply low side or ground;

a third switch connected between a junction of the first switch and the high side of the first primary winding and a point between a low side of the second primary winding and the power supply low side or ground;

a fourth switch located between the low side of the second primary winding and the point; and a fifth switch located between the point and the power supply low side or ground.

2. A method of operating a multi-charge ignition system controlled by a spark plug control unit to provide a current to a spark plug where the multi-charge ignition system includes at least two coil stages controlled by the spark plug control unit to successively energise and de-energise the at least two coil stages to provide the current to the spark plug, the at least two coil stages including a first transformer including a first primary winding inductively coupled to a first secondary winding and a second transformer including a second primary winding inductively coupled to a second secondary winding; a first switch electrically connected between a power supply high side and a high side of the first primary winding; a second switch electrically connected between a low side of the first primary winding and a power supply low side or ground; a third switch connected between a junction of the first switch and the high side of the first primary winding and a point between a low side of the second primary winding and the power supply low side or ground; a fourth switch located between the low side of the second primary winding and the point; and a fifth switch located between the point and the power supply low side or ground, the method comprising:

during an initial ramp-up phase, switching the second switch, the third switch, and the fourth switch to on, and switching the first switch and the fifth switch to off.

3. A method as claimed in claim 2, further comprising, after the initial ramp-up stage, switching the second switch and the fourth switch to off.

4. A method as claimed in claim 3, further comprising, in a non-operational state which is prior to the initial ramp-up stage, setting the first switch, the second switch, the third switch, the fourth switch, and the fifth switch all to off.

5. A method as claimed in claim 3, further comprising during a coupled multi-charge phase which is after the initial ramp-up stage, setting the switches alternately to/from the following settings a) the first switch and the second switch on, the third switch, the fourth switch, and the fifth switch off and b) the first switch, the second switch, and the third switch off, the fourth switch and the fifth switch on.

6. A method as claimed in claim 3, further comprising in a step-down phase which is after the initial ramp-up stage, setting the switches a) the first switch, the third switch, and the fourth switch on, the second switch and the fifth switch off, and toggling the third switch and the fifth switch.

7. A method as claimed in claim 3, further comprising in a step-down phase which is after the initial ramp-up stage, switching the second switch, the third switch, and the fifth switch on, switching the first switch and the fourth switch off, and toggling the first switch and the third switch.

8. A method of operating a multi-charge ignition system controlled by a spark plug control unit to provide a current to a spark plug where the multi-charge ignition system includes at least two coil stages controlled by the spark plug control unit to successively energise and de-energise the at least two coil stages to provide the current to the spark plug, the at least two coil stages including a first transformer including a first primary winding inductively coupled to a first secondary winding and a second transformer including a second primary winding inductively coupled to a second secondary winding; a first switch electrically connected between a power supply high side and a high side of the first primary winding; a second switch electrically connected between a low side of the first primary winding and a power supply low side or ground; a third switch connected between a junction of the first switch and the high side of the first primary winding and a point between a low side of the second primary winding and the power supply low side or ground; a fourth switch located between the low side of the second primary winding and the point; and a fifth switch located between the point and the power supply low side or ground, the method comprising:

during a coupled multi-charge phase, setting the switches alternately to/from the following settings a) the first switch and the second switch on, the third switch, the fourth switch, and the fifth switch off and b) the first switch, the second switch, and the third switch off, the fourth switch and the fifth switch on.

9. A method of operating a multi-charge ignition system controlled by a spark plug control unit to provide a current to a spark plug where the multi-charge ignition system includes at least two coil stages controlled by the spark plug control unit to successively energise and de-energise the at least two coil stages to provide the current to the spark plug, the at least two coil stages including a first transformer including a first primary winding inductively coupled to a first secondary winding and a second transformer including a second primary winding inductively coupled to a second secondary winding; a first switch electrically connected between a power supply high side and a high side of the first primary winding; a second switch electrically connected between a low side of the first primary winding and a power supply low side or ground; a third switch connected between a junction of the first switch and the high side of the first primary winding and a point between a low side of the second primary winding and the power supply low side or ground; a fourth switch located between the low side of the second primary winding and the point; and a fifth switch located between the point and the power supply low side or ground, the method comprising:

in a step-down phase, setting the switches a) the first switch, the third switch, and the fourth switch on, the second switch and the fifth switch off, and toggling the third switch and the fifth switch.

10. A method of operating a multi-charge ignition system controlled by a spark plug control unit to provide a current to a spark plug where the multi-charge ignition system includes at least two coil stages controlled by the spark plug control unit to successively energise and de-energise the at least two coil stages to provide the current to the spark plug, the at least two coil stages including a first transformer including a first primary winding inductively coupled to a first secondary winding and a second transformer including a second primary winding inductively coupled to a second secondary winding; a first switch electrically connected between a power supply high side and a high side of the first primary winding; a second switch electrically connected between a low side of the first primary winding and a power supply low side or ground; a third switch connected between a junction of the first switch and the high side of the first primary winding and a point between a low side of the second primary winding and the power supply low side or ground; a fourth switch located between the low side of the second primary winding and the point; and a fifth switch located between the point and the power supply low side or ground, the method comprising:

in a step-down phase, switching the second switch, the third switch, and the fifth switch on, switching the first switch and the fourth switch off, and toggling the first switch and the third switch.

* * * * *